US009272328B2

(12) United States Patent
Arnold

(10) Patent No.: US 9,272,328 B2
(45) Date of Patent: Mar. 1, 2016

(54) METHOD FOR CASTING A CAST PIECE WITH AT LEAST ONE THROUGH-OPENING

(71) Applicant: Fritz Winter Eisengiesserei GmbH & Co. KG, Stadtallendorf (DE)

(72) Inventor: Klaus Arnold, Mandelbachtal (DE)

(73) Assignee: Fritz Winter EisengieBerei GmbH & Co. KG, Stadtallendorf (DE)

( * ) Notice: Subject to any disclaimer, the term of this patent is extended or adjusted under 35 U.S.C. 154(b) by 0 days.

(21) Appl. No.: 14/397,997

(22) PCT Filed: Apr. 23, 2013

(86) PCT No.: PCT/EP2013/058396

§ 371 (c)(1),
(2) Date: Oct. 30, 2014

(87) PCT Pub. No.: WO2013/164225

PCT Pub. Date: Nov. 7, 2013

(65) Prior Publication Data

US 2015/0122447 A1 May 7, 2015

(30) Foreign Application Priority Data

May 3, 2012 (DE) ..... 10 2012 103 884

(51) Int. Cl.

| | |
|---|---|
| ***B22D 15/02*** | (2006.01) |
| ***B22D 27/04*** | (2006.01) |
| ***B22D 29/00*** | (2006.01) |
| ***B22D 30/00*** | (2006.01) |
| ***B22C 9/02*** | (2006.01) |

(Continued)

(52) U.S. Cl.

CPC ..... *B22D 15/02* (2013.01); *B22C 5/085* (2013.01); *B22C 9/02* (2013.01); *B22C 9/103* (2013.01); *B22D 27/04* (2013.01); *B22D 29/001* (2013.01); *B22D 29/003* (2013.01); *B22D 30/00* (2013.01)

(58) Field of Classification Search

CPC .... B22D 29/001; B22D 29/003; B22D 30/00; B22D 27/04; B22D 15/02; B22C 9/02; B22C 9/103

USPC ..... 164/122, 124

See application file for complete search history.

(56) References Cited

U.S. PATENT DOCUMENTS

| | | | |
|---|---|---|---|
| 5,058,655 | A | 10/1991 | Derp et al. |
| 7,226,493 | B2 | 6/2007 | Grong et al. |

(Continued)

FOREIGN PATENT DOCUMENTS

| | | | |
|---|---|---|---|
| CN | 1261562 | A | 8/2000 |
| DE | 3118928 | A1 | 12/1982 |
| DE | 19530254 | A1 | 2/1997 |

(Continued)

*Primary Examiner* — Kevin P Kerns

(74) *Attorney, Agent, or Firm* — The Webb Law Firm

(57) ABSTRACT

A method to produce cast pieces with optimum mechanical properties having through-openings with minimal outlay in terms of equipment. A casting mold in which at least one casting core is used. A through-channel leading through the through-opening of the cast piece is formed by burning the binder in the molding material out of the casting core representing the through-opening by means of the heat input into the casting mold when pouring the molten metal into the casting mold, or by mechanically destroying, at least in part, the respective casting core representing the through-opening and the regions of the casting mold arranged in the extension of the casting core.

10 Claims, 5 Drawing Sheets

(51) Int. Cl.
*B22C 9/10* (2006.01)
*B22C 5/08* (2006.01)

(56) References Cited

U.S. PATENT DOCUMENTS

| | | | |
|---|---|---|---|
| 2006/0207742 | A1 | 9/2006 | Garza-Ondarza et al. |
| 2013/0092341 | A1 | 4/2013 | Stephan et al. |

FOREIGN PATENT DOCUMENTS

| | | | |
|---|---|---|---|
| DE | 60129004 | T2 | 9/2007 |
| DE | 112006000627 | T5 | 4/2008 |
| DE | 102008048761 | A1 | 3/2010 |
| DE | 102010003346 | A1 | 9/2011 |
| JP | 59179263 | A | 10/1984 |
| JP | 6114068 | A | 1/1986 |
| JP | 3138068 | A | 6/1991 |
| JP | 7164131 | A | 6/1995 |
| WO | 03076108 | A1 | 9/2003 |

METHOD FOR CASTING A CAST PIECE WITH AT LEAST ONE THROUGH-OPENING

CROSS-REFERENCE TO RELATED APPLICATIONS

This application is the United States national phase of International Application No. PCT/EP2013/058396 filed Apr. 23, 2013, and claims priority to German Patent Application No. 10 2012 103 884.8 filed May 3, 2012, the disclosures of which are hereby incorporated in their entirety by reference.

BACKGROUND OF THE INVENTION

1. Field of the Invention

The invention relates to a method for casting a molten metal cast piece provided with at least one through-opening. The cast pieces referred to here are typically cylinder crankcases for high-capacity combustion engines which are cast from a cast iron metal.

2. Description of Related Art

Modern combustion engines are constantly being developed in order to reduce fuel consumption. Reducing the volume and weight of the components is key here. This trend is described among experts as 'downsizing'. The aim of 'downsizing' is, for example, to achieve performances with smaller engine sizes that previously required a larger overall installed size.

Successful downsizing of combustion engines requires inter alia enhancement of the technological properties of their individual components. Thus, the achievable performance can be more than trebled with modern engine designs at the same installation size.

Cast iron with vermicular graphite is sometimes used today instead of conventional cast iron to ensure the adequate resilience of cast iron cylinder crankcases at said power density, or high alloy cast iron materials are used to achieve the required strength.

The cast pieces of the type described above are typically cast in casting moulds, which are made up of several moulded parts and casting cores. Whilst moulded parts generally determine the external shape of a cast piece, casting cores are placed into casting moulds to represent recesses, cavities, through-openings and similar in the cast piece to be produced.

Depending on their position in or on the cast piece and the ease with which they can be removed from the mould after the cast piece has set, moulded parts and casting cores are configured as permanent moulded parts and permanent casting cores or as lost moulded parts and casting cores. Whilst permanent moulded parts and casting cores consist of materials, which can withstand the stresses and strains that occur during casting, and therefore can be used repeatedly for a large number of casting processes, lost moulded parts and casting cores usually consist of moulding materials which can be destroyed easily by the application of force or the effect of temperature. If a casting mould consists, entirely, or at least to a substantial extent, of lost moulded parts and casting cores, it is usually referred to as a lost mould, whereas casting moulds, which consist primarily of permanent, moulded parts, are referred to as permanent casting moulds even if lost casting cores are placed therein. Lost moulds are typically used for cast iron casting, whilst, permanent, casting moulds or a combination of permanent moulded parts and lost moulded parts are frequently used in light metal casting.

Lost moulded parts and casting cores are typically made of moulding materials consisting of sand mixed with an appropriate binder, which hardens when producing the respective moulded parts or casting cores as a result of a chemical reaction, provided it retains adequate dimensional stability until the molten mass cast in the casting mould sets. The components of the moulding material can be coordinated here such that the respective casting core or moulded part automatically breaks into pieces while the casting piece is cooling as a result of the stresses and strains that occur. Alternatively, or additionally, the disintegration of lost moulded parts and casting cores can be effected by applying mechanical forces. Thus, for example, casting cores can be destroyed by shaking the respective cast piece into such tiny pieces that the moulding material thereof automatically trickles out of the cast piece, or the destruction of the casting cores is speeded up by drilling, extrusion or flushing. The prerequisite for this, however, is that the cast piece is substantially completely cool so that the stresses and strains occurring during the mechanical or thermal destruction of the lost casting cores and moulded parts does not result in damage to the cast piece.

The process of cooling the cast piece has a crucial influence of its mechanical properties. Problems may occur when cooling a cast piece in that the cast piece cools at different rates in different areas as a result of uneven distribution of material or an irregular heat supply. Internal stresses and strains may occur in the cast piece as a result of such uneven cooling, which may lead to a dramatic deterioration of its mechanical loading capacity.

In order to minimise the occurrence of such stresses and strains, cooling from the casting temperature to a temperature usually below 600° C. is performed deliberately slowly when casting cast pieces with wall thicknesses that vary considerably. The casting plants used in practice are equipped with cooling sections of a specific length for this purpose, wherein said cooling sections may also include 'cooling stations' where the casting moulds containing the cast pieces to be cooled can dwell for a specific period in order to further delay cooling. If no means are available to guarantee sufficiently slow cooling, or if internal stresses and strains that are too high are still present in the cast piece even after such slow cooling, the cast pieces must be subjected to additional annealing in order to reduce the respective stresses and strains.

As an alternative option for minimising the tensile stresses in the inner region of a cylinder crankcase, DE 10 2008 048 761 A1 suggests cooling the molten metal after it has been poured into the casting mould in a directed manner such that setting of the molten mass is effected firstly inside the cast piece or a region of the cast, piece directed towards a feeder head is set. It should be possible to achieve this by influencing the setting of the respective cast piece by means of different cooling capacity of at least two independent cooling circuits provided on the respective casting mould. However, this can only be accomplished if the respective casting mould is configured as a permanent casting mould at least in the regions in which the cooling capacity is intended to be applied in a targeted manner. Specially formed sleeves are thus provided for moulding the cylinder openings of the respective cylinder crankcase, which are drawn out of the casting without damage after setting. It has proven advantageous for the removal of the sleeves after setting, if cooling of the edge of the cylinder openings is started at a different time from the cooling of the cylinder surface and the cylinder edge is cooled at a different intensity from the cooling of the cylinder surface. In this manner, the setting of the cast cylinder crankcase in the region of the cylinder openings can be performed such that the cylinder crankcase can be removed from the mould at a point when although it is set, it is still at a high temperature.

Another option for targeted accelerated cooling of cast piece regions, which are arranged inside the respective component part, is described in DE 11 2006 000 627 T5. The sand casting mould known from this document for producing a cast piece made of an aluminium alloy comprises a portion, which is formed by means of a solvent, more particularly water, soluble binder, and a further portion which is formed by means of a binder, which cannot be dissolved using the respective solvent. This division of the sand mould portions enables removal of the core formed on the basis of the soluble binder by applying pressure with the solvent, i.e. by applying pressure by means of a jet of water, for example, and consequently the inner regions of the cast piece exposed to the effect of the solvent cool more rapidly that the rest of the cast piece. Said solution only applies to cavities, which are present in the cast piece, and requires a complex design of the sand mould from different moulding materials.

Another suggestion for accelerated cooling of the regions of a cast piece surrounding a through-opening, designed for a special application scenario and suitable for light metal casting, is made in DE 10 2010 003 346 A1. In the method described here for casting a piston for a combustion engine, once the surface layers in the region of the piston pin bores nave set, the sleeves provided for removing said bores from the mould are drawn back and the region of the respective bore is cooled by means of a cooling agent, which is supplied through at least one of the sleeves.

Against the background of the prior art described above, the problem to be solved by the invention consisted in providing a method, which makes it possible to produce cast pieces with through-openings having optimum mechanical properties in a manner that requires minimal outlay in terms of equipment.

SUMMARY OF THE INVENTION

The method as per the invention for casting a molten metal cast piece with at least one through-opening includes the following steps:

a) Provision of a casting mould, in which at least one casting core is present to represent the through-opening, wherein the casting core consists of a moulding material comprising a binder, which material disintegrates under the effect of force or temperature,
b) Pouring of the molten metal in the casting mould to form the cast piece,
c) Cooling of the cast piece in the casting mould to a temperature, which is below the liquidus temperature of the molten metal, but above a minimum temperature, from which minimum temperature accelerated cooling effects the formation of a high-tensile structure,
d) Formation of a through-channel leading through the through-opening of the cast piece, which in each case opens onto an external side of the casting mould, by burning the binder in the moulding material out of the casting core representing the through-opening by means of the heat input into the casting mould when pouring the molten metal into said casting mould, or by mechanically destroying, at least in part, the casting core representing the through-opening and the regions of the casting mould arranged in the extension of said core,
e) Cooling of the cast piece in the casting mould whilst a cooling medium flows through the through-channel.

The invention is based on the concept of creating a condition, when cooling the cast piece after the molten metal has been poured into the mould, through an intervention in the casting mould, as a result of which the inner region of the cast piece, which is critical in terms of its future loading capacity, is cooled at a rate that is significantly faster than the rate at which said region of the cast piece would be cooled if the casting mould remained in a conventional manner in the condition in which the casting was performed until it cooled to ambient temperature.

For this purpose, as per the invention, a through-channel crossing through the casting mould leading through the at least one through-opening of the cast piece is provided in the casting mould at a point when the cast piece has not completely cooled, but is rigid.

A cooling medium then flows through said through-channel. As the cooling medium flows through, it causes the cast piece material surrounding the through-opening to cool much more quickly than would be the case if the casting mould remained sealed in a conventional manner until the cast piece reached the prescribed end cooling temperature. Depending on the cooling medium used, on the flow rate of the cooling medium and on the nature and manner in which the through-channel placed in the casting mould as per the invention is configured and guided, cooling rates can be achieved which are faster than the cooling rates which are achieved on the external side of the casting mould.

The temperature gradient between the inner and outer regions can be reduced dramatically using the method as per the invention and, at the same time, the cooling rate of the east piece can generally be increased. In this manner, firstly heat-related stresses and strains in the cast piece are reduced to a minimum and secondly, strengths are achieved in the cast pieces produced in a manner as per the invention, which are significantly greater than the strengths of cast pieces cast in a conventional manner and cooled in the casting mould without additional measures.

The method as per the invention proves particularly effective when producing cast pieces from molten cast iron. In this case the minimum temperature, to which the cast piece is cooled at most until the formation of the through-channel to be placed in the casting mould as per the invention (step c)), is set such that it is higher than the $A_1$ temperature at which it transformation of austenite occurs. The accelerated cooling permitted inside the cast piece as per the invention thus allows the formation of a larger percentage of martensitic structure, which contributes to a significant increase in strength. In the case of cast iron alloys, used particularly in cylinder crankcase casting, the minimum temperature, which is not fallen below during cooling in step c), is typically between 1153 and 600° C.

The cooling medium can be air, for example, or another gaseous medium. In cases where a specific higher minimum cooling rate is required, for example, the use of steam or a mixture of air and steam as the cooling medium is possible.

The flow of a continuous gaseous cooling medium through the through-channel in the vicinity of the casting mould discussed as per the invention, is initiated as a result of the chimney effect, which occurs due to the release of thermal energy from the cast piece to the gaseous cooling medium entering the through-channel as result of convection. Said effect can be boosted by directing the cast piece with the casting mould or configuring the through-channel inserted into the casting mould such that the direction of the through-channel is mainly vertical. In this case, the air present in the through-channel or flowing into said through-channel and heated can rise unimpeded in the through-channel.

If faster flow rates are required, the cooling medium can also be guided through the through-channel in a forced stream. The cooling medium stream can be forced by means of a conveying device for this purpose, where said device can be a ventilator or a pump, for example. The respective conveying device can be positioned for this purpose for example, upstream of one of the openings of the through-channel arranged on one of the outer lateral surfaces or, if required, set into the through-channel after the latter has been put in place.

Naturally, the approach as per the invention can also be used with cast pieces that have several through-openings. In this case, a through-channel is formed in the region of each of the through-openings as required, through which the cooling medium then flows in order to effect the accelerated cooling as per the invention in the respective through-opening.

Particular success can be achieved using the procedure as per the invention if the cast piece discussed as per the invention is a cylinder crankcase for a combustion engine and the through-opening is at least one cylinder opening provided in the cylinder crankcase. In this case, for example, before the cast piece has cooled completely, the casting cores representing the respective cylinder openings are removed completely as well as the casting core representing the crankcase and the parts of the casting mould, which are arranged in the extension of the cylinder opening, are removed at least to the extent that air or another gaseous cooling medium can flow through the cylinder opening, whilst the other parts of the cast piece are still enclosed by the casting mould. Due to the fact that the invention enables accelerated cooling inside the cast piece, greater strengths are generally achieved than are possible using conventional casting methods in which cast, pieces in the sealed mould cool solely on account of the flow of heat over the external sides of the casting mould. It is possible here that greater strength can be achieved specifically by means of localised accelerated cooling in the region directly adjacent to the respective cylinder opening than in the region surrounding the cylinder crankcase that is further away, which cools more slowly there than the region coated directly by the cooling medium in the manner according to the invention and thus retains its toughness.

The approach as per the invention can foe put into practice particularly easily, cost-effectively and flexibly due to the fact that the casting mould is configured entirely or at least in the region of the Through-opening as a core package, the moulded parts and casting cores of which, which are arranged in the region of the through-opening and the extension of the casting core representing the through-opening, consist of a moulding material, which disintegrates under the effect of force or temperature.

It has proven particularly favourable under practical production conditions if, when implementing the method as per the invention, moulding box foundry technology is dispensed with entirely and the casting mould as a whole is designed as a core package.

Since, as per the invention, the casting mould consists of lost casting cores and moulded parts, at least in the region of the through-opening of the cast piece to be provided with the through-channel, the respective casting cores and moulded parts are made from conventional moulding materials, which as explained above, usually consists of sand, an organic or an inorganic binder, wherein specific additives can of course be added to the moulding material in order to optimise its properties. The moulding material binder can be configured in a manner known per se here such that the binder ensuring the dimensional stability of the moulded parts and casting cores burns as result of the heat conveyed to the casting mould when the molten metal is poured into said mould. In this case, the respective casting cores and moulded parts automatically disintegrate into small pieces, which then, also automatically, trickle out or the casting mould or the cast, piece when the through-channel is exposed.

Alternatively or additionally, it can also be advantageous, particularly in terms of increasing the effectiveness and targeting of the method as per the invention, to specifically effect the destruction by mechanical means of the moulded parts and casting cores assigned to the respective through-channel, which is required in order to form the through-channel in the casting mould. The casting cores or moulded parts assigned to the respective through-channel of the cast piece can be pressed out by means of a stamp, for example, or the through-channel can be created in the casting mould using a drill.

In order to enable cooling of the material region of the cast piece surrounding the respective through-opening that is as intense and rapid as possible, the at least one casting core representing the through-opening and regions of the casting mould arranged in the extension of said core are generally removed completely in practice when forming the through-channel.

If, however, the intention, is to effect accelerated cooling in the region of the respective through-opening of the cast piece, but not that the cooling medium directly contacts the respective surfaces of the cast piece defining the through-opening, the through-channel can be guided through the respective through-opening of the cast piece, in particular by mechanical means, such that the casting core forming the through-opening of the cast piece is only partially removed. Casting core sand then remains present between the through-channel and the inner surface of the through-opening, which still has a certain insulating effect. Accordingly, the cooling of the region adjacent to the through-opening is not as rapid, depending on the thickness of the residual casting core material, as would be the case if the casting core representing the through-opening were removed entirely and the inner surface of the through-opening were directly in contact with the cooling medium.

BRIEF DESCRIPTION OF THE DRAWINGS

The cost, effectiveness of the method as per the invention can be increased even further if the casting mould has at least two cavities for simultaneous casting of at least two cast pieces and the molten metal is guided into the cavities of the casting mould by means of a common feeder.

The invention is explained in further detail below using figures showing embodiments. The figures are simplified, schematic and are not drawn to scale.

DESCRIPTION OF THE INVENTION

Figure 1:
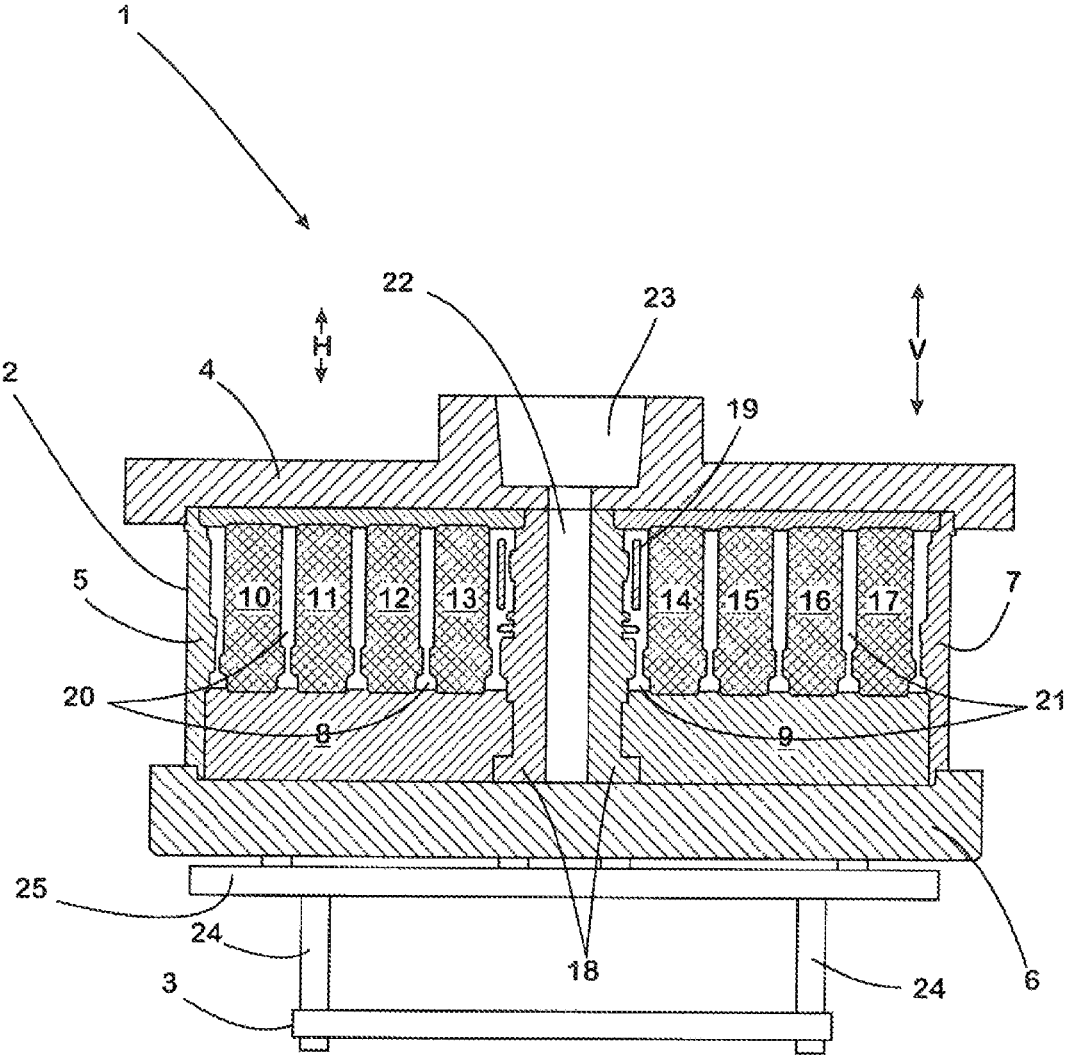
FIG. 1 shows a longitudinal section of a device for casting two cast pieces.

The device 1 for the simultaneous casting of two cast pieces Z1, Z2 includes a casting mould 2, which is supported on a frame 3. The cast pieces Z1, Z2 are conventionally designed cylinder crankcases intended for the construction of an inline four cylinder combustion engine.

The casting mould 2 as a core package comprises external moulded parts 4,5,6,7 and casting cores 8-19 arranged inside the casting mould 2. Whilst the external moulded parts 4-7 determine the external shape of the pieces to be cast Z1, Z2, the casting cores 8,9 represent the internal shape of the crankcase K1, K2 with the crankshaft bearings L1, L2 and the casting cores 10-17 represent the cylinder openings of the cast pieces Z1, Z2 configured as a through-opening O1,O2. The laterally arranged moulded parts 5, 7 thereby form one front side of the respective cast piece Z1, Z2, whilst the respective casting cores 18, arranged opposite the assigned external moulded part 5,7, represent the front side of the respective cast piece Z1, Z2 arranged here inside the casting mould 2. The other casting cores 19, for example, serve to form water or oil channels in the cast pieces Z1, Z2. The casting mould 2 is aligned here such that the through-openings O1, O2 are directed mainly (main direction H) in a vertical direction V.

The cavities 20, 21 of the casting mould 2 defined by the moulded parts 4-7 and casting cores 8-19 when the casting mould is empty are connected here by means of portions (not shown) with a common gate 22 arranged centrally in the casting mould 2 and vertically aligned. The central gate 22 is in turn connected to a feeder 23 also configured centrally on the top side of the casting mould 2, by means of which feeder 23 the casting mould 2 is filled with molten cast iron S. The gate 22 and the other portions of the casting mould 2 not shown here are positioned such that the cavities 20, 21 are filled contrary to the effective pull R of gravity.

The casting mould 2 sits on a grid 25 of the frame 3 supported by stays 24.

The external moulded parts 4,5,6,7 and casting cores 8-19 are formed from a commercially available moulding material that is a mixture of an inorganic binder and sand, which hardens by applying heat and removing moisture to the extent that it has sufficient dimensional stability to support the casting mould 2 and withstand the forces that occur during the casting process. However, due to the increase in temperature associated with the pouring of the molten cast iron S into the mould, particularly those moulded parts 4,5,6,7 and casting cores 8-19, which are directly exposed to the pouring heat of the molten cast iron S, start to disintegrate.

Figure 2:
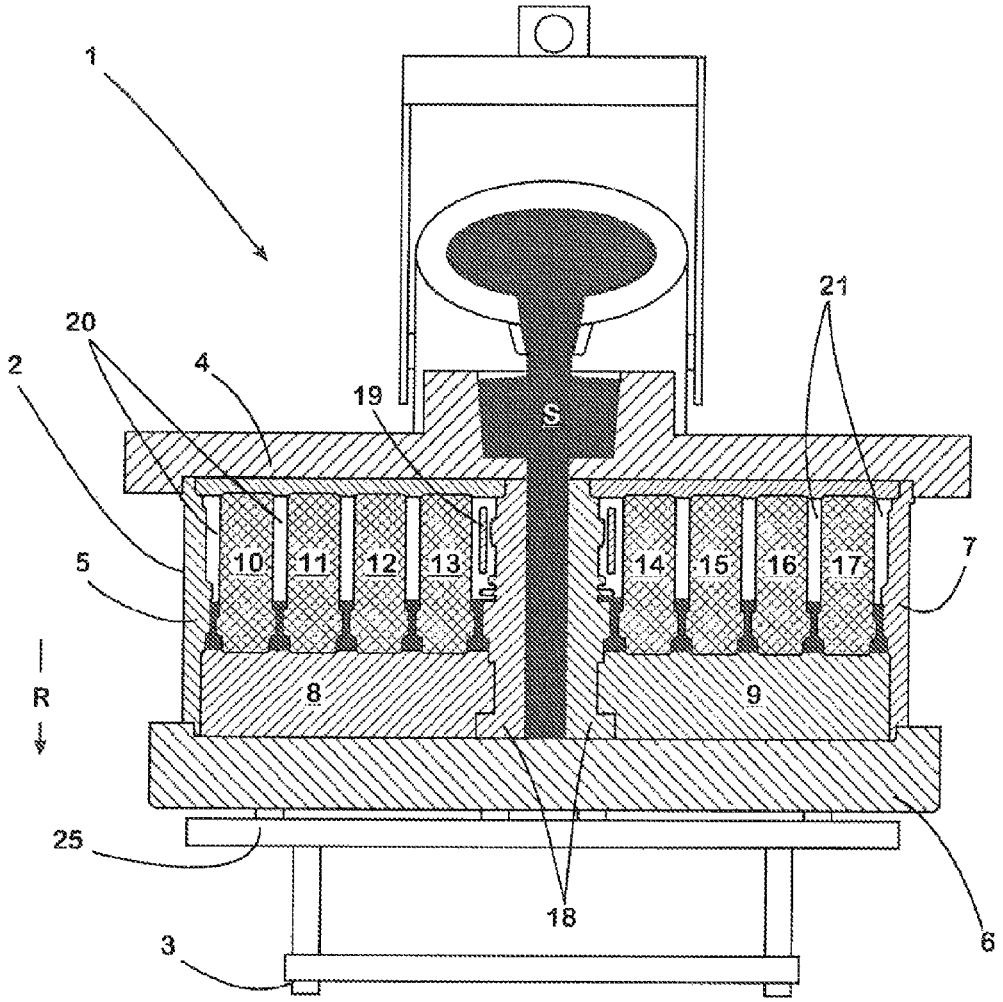
FIG. 2 shows a side view according to FIG. 1 of the device as per FIG. 1 during the pouring of molten cast iron.

Once the casting mould 2 has been filled with the molten cast iron S (FIG. 2) the cast pieces Z1, Z2 cool to a minimum temperature between 850 and 650° C., at which the cast material sets on the one hand, but on the other hand, the temperature of the cast pieces Z1, Z2 is still high enough that a martensitic structure can be produced through accelerated cooling. Ideally, the temperature is high enough that the structure of the cast pieces Z1, Z2 is still entirely austenitic.

Figure 3:
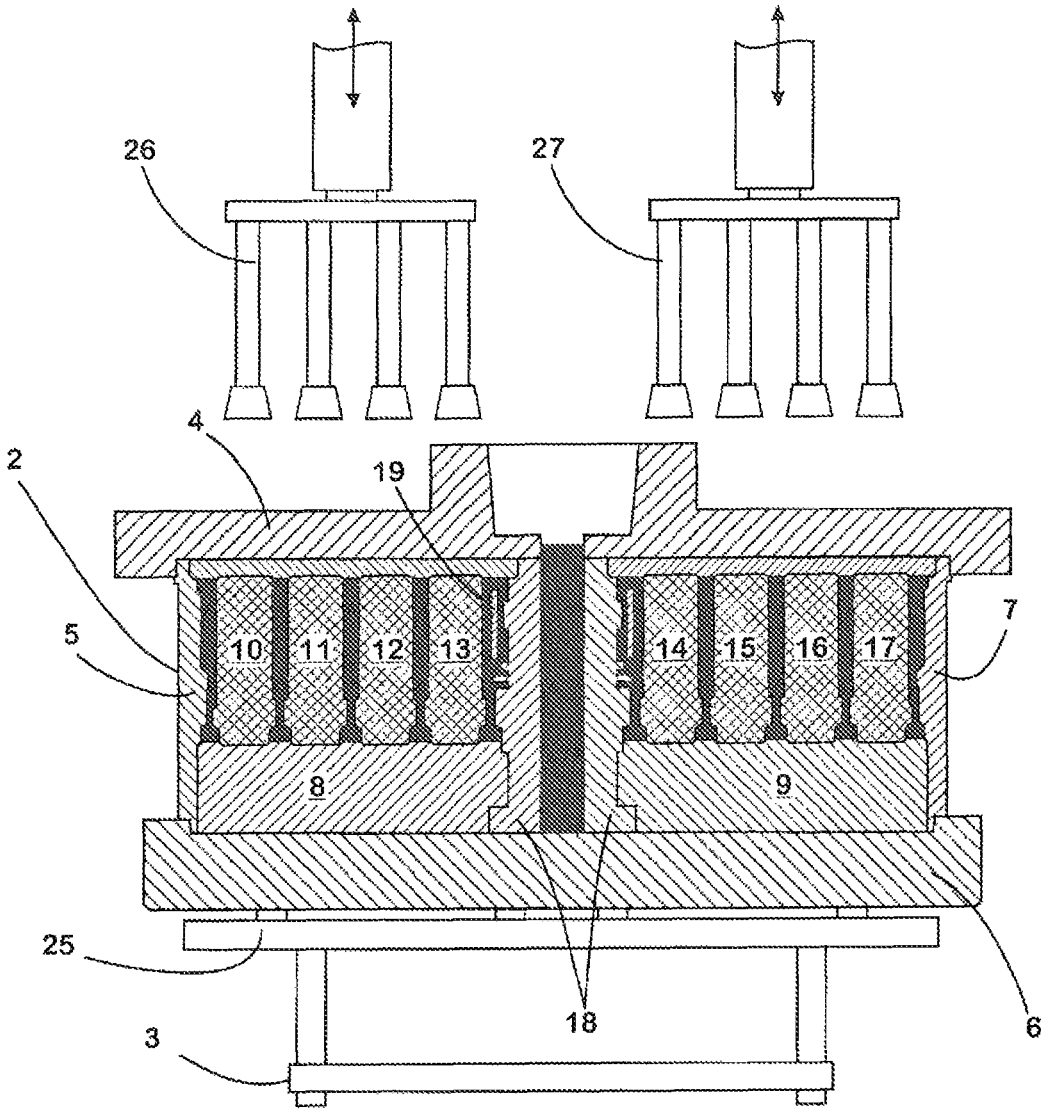
FIG. 3 shows a side view corresponding to FIG. 1 of the device as per FIG. 1 after the molten cast iron has set.
Figure 4:
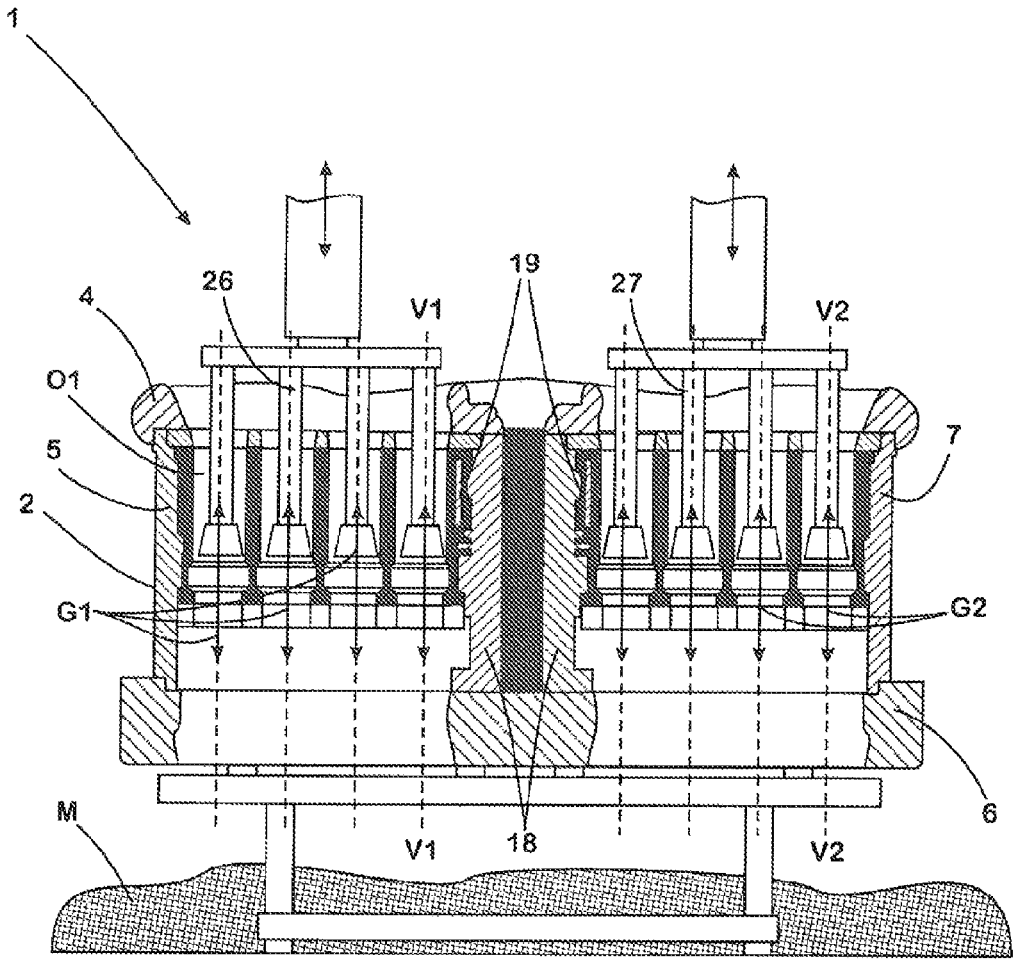
FIG. 4 shows a side view corresponding to FIG. 1 of the device as per FIG. 1 during manufacture of through-channels.

If this state is achieved (FIG. 3), through-channels G1, G2 are introduced into the casting mould 2 (FIG. 4), each of which is assigned to the through-openings O1, O2 of the cast piece Z1, Z2. To this end, the casting cores 10-17, representing the through-openings O1,O2 of the cast pieces Z1, Z2, which have already disintegrated into small pieces at this point, as well as the above-lying portions of the external moulded part 4 forming the cover of the casting mould 2 in the intended extension of said cores VI, V2, and, in the intended extension thereof, the underlying casting cores 8,9 representing the crankcase K1, K2 with the crankshaft bearings L1, L2, as well as the portions also in the extension V1, V2 lying below the casting cores 8, 9, portions of the lower moulded part 6 forming the base of the casting mould 2 are pushed out of the casting mould 2 by means of pushers 26, 27, each of which is assigned to one of the through-openings O1, O2 of the cast pieces 21, Z2. The top end of the through-channels G1, G2 formed in this manner leading through the through-openings O1, O2 opens accordingly on to the external side formed by the upper external surface of the cover moulded part 4 and the bottom end onto the lower external side of the casting mould 2 formed by the lower external surface of the base moulded part 6.

The pushed-out moulded part portions and broken casting core pieces disintegrate in the process into a free-flowing, fragmented material M, which falls through the frame grid and collects on the floor below the casting mould 2. The trickling of the moulding material M out of the casting mould 2 can be assisted, if required, in a manner known per se by shaking, knocking or other mechanical actions. The material M falling from the casting mould 2 can be removed by a conveying device not shown here.

Figure 5:
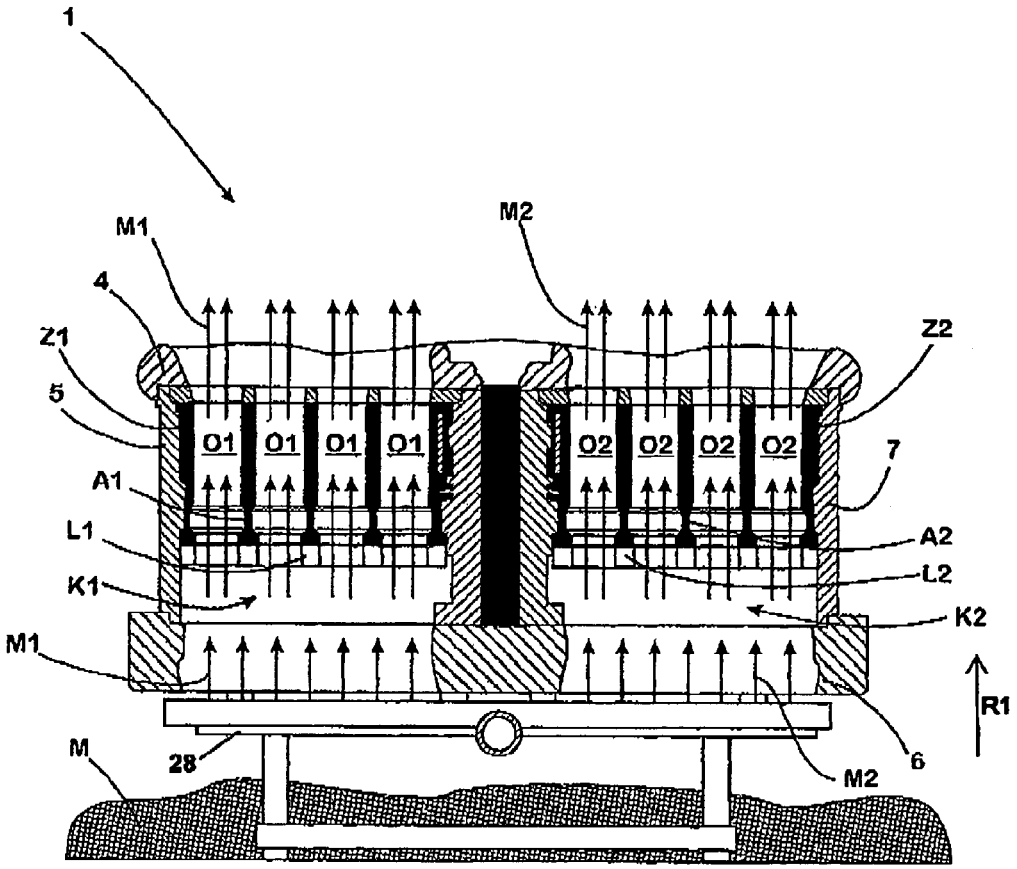
FIG. 5 shows a side view corresponding to FIG. 1 of the device as per FIG. 1 whilst a cooling medium flows through the through-channels.

Once the through-channels G1, G2 have been exposed thus allowing the cast pieces Z1, Z2 to flow through them in a vertical direction V, a nozzle assembly 28 is positioned below the casting mould 2, by means of which a cooling medium flow M1, M2, accelerated by means of a fan (not shown here), is blown into the casting mould 2 from below in a vertical direction R1 (FIG. 5). Air is the cooling medium in the embodiment explained here.

The respective cooling medium flow M1, M2 flows through the through-channels G1-G2 leading through the through-openings O1,O2 of the cast pieces Z1, Z2 and effects accelerated cooling of the wall portions of the cast pieces Z1,Z2 coated by said medium. A structure characterised by banded perlite with simultaneous fine granulation thus occurs particularly in the region of the through-openings O1, O2, the crankshaft bearings L1, L2 and the respective tension rods A1, A2 supporting the crankshaft bearings L1, L2. Said structure has a greater strength than the strength achieved in cast pieces which are cooled in a conventionally manner, solely through natural heat loss via the external moulded parts of the casting mould thereof. The difference in temperature between the regions arranged inside the cast pieces Z1, Z2 adjacent to the through-openings O1, O2, the crankshaft bearings L1, L2 and the tensile rods A1, A2 supporting the crankshaft bearings respectively, and the external regions of the cast pieces Z1, Z2 that are further away, which cool at comparable rates due to the fact that walls are less thick there, is minimised accordingly.

Overall, proceeding in this manner results in the temperature gradient, between, the external and internal region of the cast pieces Z1, Z2 remaining low. The low temperature gradient reduces residual tensile stresses in the internal region. At the same time, the faster cooling rate produces greater tensile strength of the cast iron material and consequently proceeding as per the invention results in loading capacities of the cast pieces Z1, Z2, which are 50% greater than the loading capacity of conventionally produced cylinder crankcases that are cooled slowly in the casting mould.

REFERENCE NUMERALS

1 Device for simultaneous casting of two cast pieces Z1, Z2
2 Casting mould
3 Frame
4-7 External moulded parts of casting mould 2
8-19 Casting cores
20,21 Cavities in casting mould 2
22 Central gate of casting mould 2
23 Feeder for casting mould 2
24 Stays for frame 3
25 Grid of frame 3
26,27 Pushers
28 Nozzle assembly
A1,A2 Tension rods for cast pieces Z1, Z2
G1-G2 Through-channels of casting mould 2

H Main direction of through-openings O1,O2
K1,K2 Crankcases in cast pieces Z1, Z2
L1,L2 Crankshaft bearings in cast pieces Z1, Z2
M Moulding material
M1,M2 Cooling medium flows
O1,O2 Through-openings (cylinder openings) in cast pieces Z1,Z2
R affective pull of gravity
S Molten cast, iron
V Vertical direction
V1,V2 Intended extension of through-openings O1,O2 in casting mould 2
Z1,Z2 Cast pieces (cylinder crankcase)

The invention claimed is:

1. A method for casting a cast piece made of molten metal provided with at least one through-opening, comprising the following steps:

a) providing a casting mould in which at least one casting core is present to represent the at least one through-opening, wherein the at least one casting core consists of a moulding material comprising a binder which material disintegrates under the effect of force or temperature, b) pouring the molten metal into the casting mould to form the cast piece, c) cooling the cast piece in the casting mould to a temperature, which is below the liquidus temperature of the molten metal, but above a minimum temperature, from which minimum temperature accelerated cooling effects formation of a high-tensile structure, d) forming a through-channel leading through the at least one through-opening of the cast piece, which in each case opens on to an external side of the casting mould, by burning the binder in the moulding material out of the at least one casting core representing the at least one through-opening by means of heat input into the casting mould when pouring the molten metal into said casting mould, or by mechanically destroying, at least in part, the respective at least one casting core representing the at least one through-opening and the regions of the casting mould arranged in an extension of said at least one casting core, and e) cooling the cast piece in the casting mould whilst a cooling medium flows through the through-channel.

2. The method according to claim 1, wherein the molten metal is molten cast iron and the minimum temperature, above which cooling ends in step c), corresponds to the $A_1$ temperature of the molten metal.

3. The method according to claim 1, wherein the molten metal is molten cast iron and the temperature to which the cast piece is cooled in the casting mould in step c) is between 1153 and 600° C.

4. The method according to claim 1, wherein the cast piece is a cylinder crankcase for a combustion engine and the at least one through-opening is a cylinder opening provided in the cast piece.

5. The method according to claim 1, wherein the casting mould is configured as a core package, the moulded parts and casting cores of which are arranged in the region of the at least one through-opening and the extension of the at least one casting core representing the at least one through-opening, consist of a moulding material which disintegrates under the effect of force or temperature.

6. The method according to claim 1, wherein a main direction of the through-channel is vertical.

7. The method according to claim 1, wherein the at least one casting core representing the at least one through-opening and the regions of the casting mould arranged in the extension of said at least one casting core are removed completely.

8. The method according to claim 1, wherein the cooling medium is being led through the through-channel at an accelerated rate within a forced stream.

9. The method according to claim 1, wherein the cooling medium is gaseous.

10. The method according to claim 1, wherein the casting mould has at least two cavities for simultaneous casting of at least two cast pieces and the molten metal is guided into the cavities by means of a common feeder or gate.

* * * * *